United States Patent [19]

Schachar

[11] 4,359,843

[45] Nov. 23, 1982

[54] MEDICAL OFFICE CONSTRUCTION

[76] Inventor: Ronald A. Schachar, 1020 N. Highway 75, Denison, Grayson County, Tex. 75020

[21] Appl. No.: 163,506

[22] Filed: Jun. 27, 1980

[51] Int. Cl.[3] ..... E04H 3/08

[52] U.S. Cl. ..... 52/29; 52/64; 52/173 R

[58] Field of Search ..... 52/29, 31, 64, 65, 234, 52/173

[56] References Cited

U.S. PATENT DOCUMENTS

| | | | |
|---|---|---|---|
| 486,367 | 11/1892 | Bierce | 52/234 |
| 3,395,500 | 8/1968 | Smith | 52/29 |
| 3,470,871 | 10/1969 | Shoen | 52/173 |
| 3,623,283 | 11/1971 | Abromavage et al. | 52/19 |
| 3,623,284 | 11/1971 | Meyer | 52/234 |
| 3,696,805 | 10/1972 | Sweeten et al. | 52/65 |
| 3,862,525 | 1/1975 | Greenspan | 52/64 |
| 3,911,900 | 10/1975 | Shoen | 52/29 |

FOREIGN PATENT DOCUMENTS

| | | | |
|---|---|---|---|
| 621962 | 6/1961 | Italy | 52/234 |

*Primary Examiner*—James L. Ridgill, Jr.
*Attorney, Agent, or Firm*—Jerry W. Mills

[57] ABSTRACT

The specification discloses an office construction (10) for doctors, opthalmologists, dentists and the like wherein medical equipment (38) is supported on a cart (34) mounted for linear movement along a path behind multiple patient examining rooms (24) to increase equipment utilization. Each examining room (24) includes doors (30) which open when the cart (34) is positioned adjacent thereto. A conveyor system (70) and drop boxes (90) are preferably included to deliver patient charts to the examining rooms (24).

7 Claims, 5 Drawing Figures

MEDICAL OFFICE CONSTRUCTION

TECHNICAL FIELD

This invention relates generally to an office construction, and more particularly to a medical office construction wherein examination/diagnostic equipment is supported for linear movement along multiple stationary patient examining rooms.

BACKGROUND ART

Traditionally, medical examinations and treatment have been conducted in individual rooms containing specialized equipment or instruments. Consider, for example, the cases of dental or ophthalmic care. The patient is usually placed on an examining table or chair within a room containing the specialized equipment, and is then prepared for treatment. A waiting period follows to allow anesthetic or the like to take effect, after which treatment is administered with the aid of the specialized equipment in the room. Following treatment, the patient is allowed a period for recovery before leaving the room, which must then be prepared to receive the next patient.

This technique is wasteful from the standpoints of both doctor's time and equipment utilization, and limits the number of patients which can be treated within a given period of time. The use of multiple examination rooms, however, involves duplication of expensive equipment.

In an effort to solve these difficulties, there have been several attempts to mount a single piece of equipment for use by multiple examination rooms. For example, U.S. Pat. No. 3,470,871 to Shoen discloses a multiphasic screening laboratory for conducting medical examinations wherein medical instruments are supported on a track extending overhead between triangular examining rooms arranged in a circle around a central core area. U.S. Pat. No. 3,911,900 to Shoen discloses a rotating medical instrument package for placement between opposed examining rooms. U.S. Pat. No. 3,395,500 to Smith discloses a dental office floor plan in which multiple patient chairs are provided on a rotatable platform. These approaches, however, have been impractical for various reasons.

A need has thus arisen for a new and improved medical office construction wherein the doctor and his/her equipment are mounted for linear movement between plural patient examining rooms.

SUMMARY OF THE INVENTION

The present invention comprises a medical office construction which overcomes these and other difficulties associated with the prior art. In accordance with the invention, there is provided an office construction for an ophthalmic, dental or other medical facility requiring the use of specialized equipment. The construction includes a plurality of patient examining rooms arranged in a row side by side. Each examining room includes a chair for the patient, an entry door, and a pair of equipment access doors. A movable cart serving as a platform for the doctor and examination/diagnostic is mounted for movement along a linear path extending behind the examining rooms. Appropriate controls, drive means and position sensors are mounted on the cart. After the cart has been manipulated to a particular examining room, the access doors are opened and the doctor treats the patient therein with the aid of the equipment mounted on the cart. After treatment, the access doors are closed and the doctor manipulates the cart to another room to treat another patient.

In a further aspect of this invention, an overhead conveyor system is provided for transfering patient charts to the examination rooms. A drop box is associated with each examining room. Patient charts are attached to the conveyor system in a remote location according to the examining rooms assigned to the patients, and are then carried thereby and released into the appropriate drop box.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
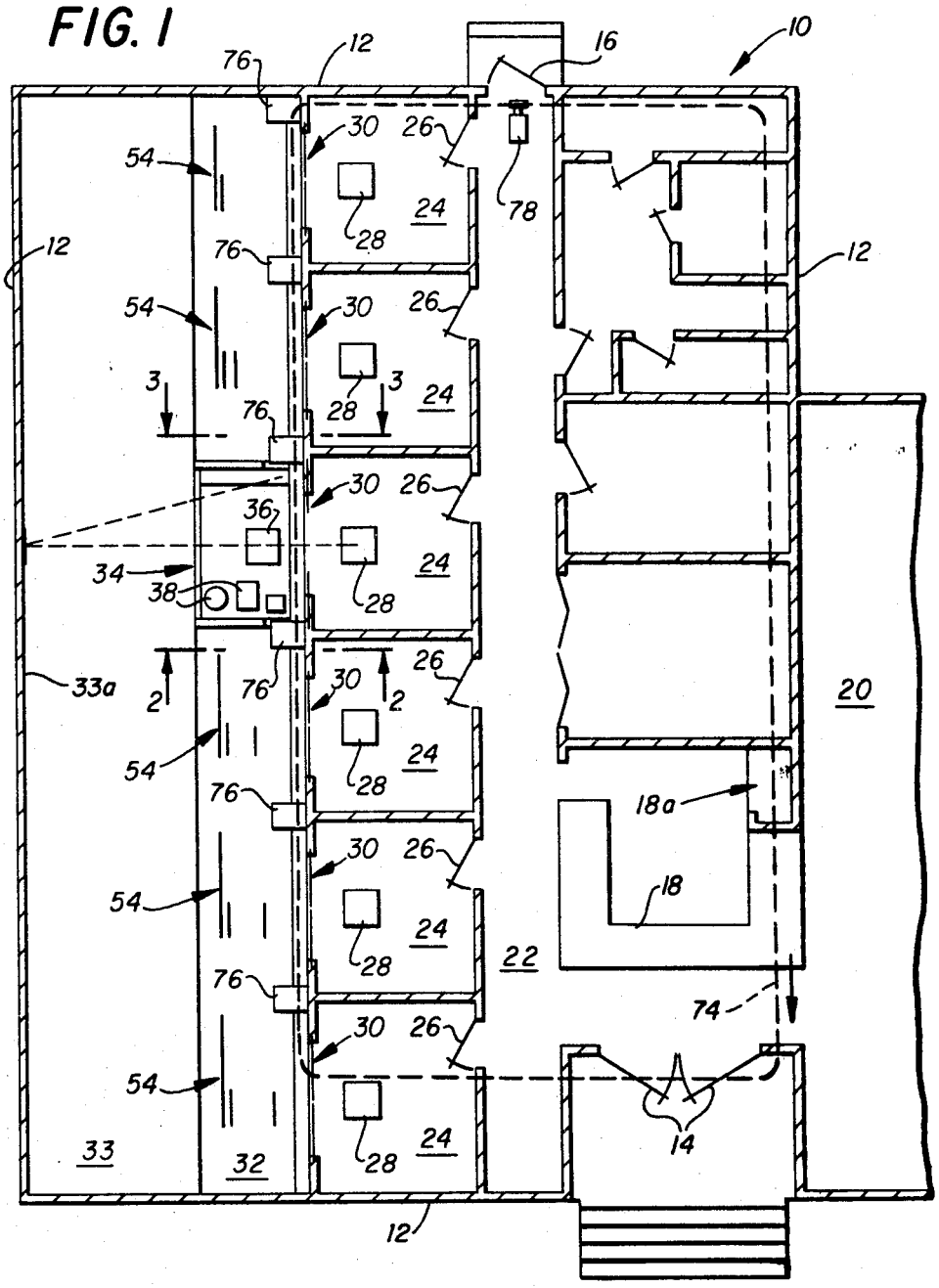
FIG. 1 is a plan view of an office construction incorporating the invention.

Referring now to the Drawings, wherein like reference numerals designate corresponding parts throughout the views, and particularly referring to FIG. 1, there is shown a plan view of the medical office 10 incorporating the invention. Office 10 includes four outside walls 12, double entry doors 14, an emergency exit door 16 at the rear, and a reception desk 18 located immediately inside the entry doors. A waiting room 20 is provided on one side of reception desk 18. On the other side of desk 18 there is a hallway 22 which leads to the patient examining rooms 24. The examining rooms 24 are arranged side by side in a substantially linear row. Medical office 10 is shown with six patient examining rooms 24, however, it will be understood that any suitable number of rooms can be utilized with the invention.

Each rectangular examining room 24 includes a hinged entry door 26, a patient chair 28, and a pair of power-actuated sliding doors 30. All of the entry doors 26 face hallway 22. The sliding doors 30 face a pit 32 and storage area 33 extending behind the examining rooms 24. Storage or work area 33 can be used to store auxiliary equipment, such as a keratometer, photocoagulator, A/B scanner, and the like in the case of an ophthalmic clinic.

A transfer cart 34 is guided within pit 32 for movement along the examining rooms 24. The cart 34 includes a rolling chair 36 for the doctor, and primary medical equipment 38. For example, equipment 38 can comprise a slit lamp, goldmann perimeter, lensometer, trial set, projectoscope, and other ophthalmic instruments for examining the eyes of a patient and determining the correction necessary, if any, dental equipment for performing intraoral procedures on the teeth of a patient, radiation equipment, or any other type of specialized devices desired to be utilized more efficiently. It will thus be appreciated that transfer cart 34 carries the doctor as well as equipment 38.

Figure 2:
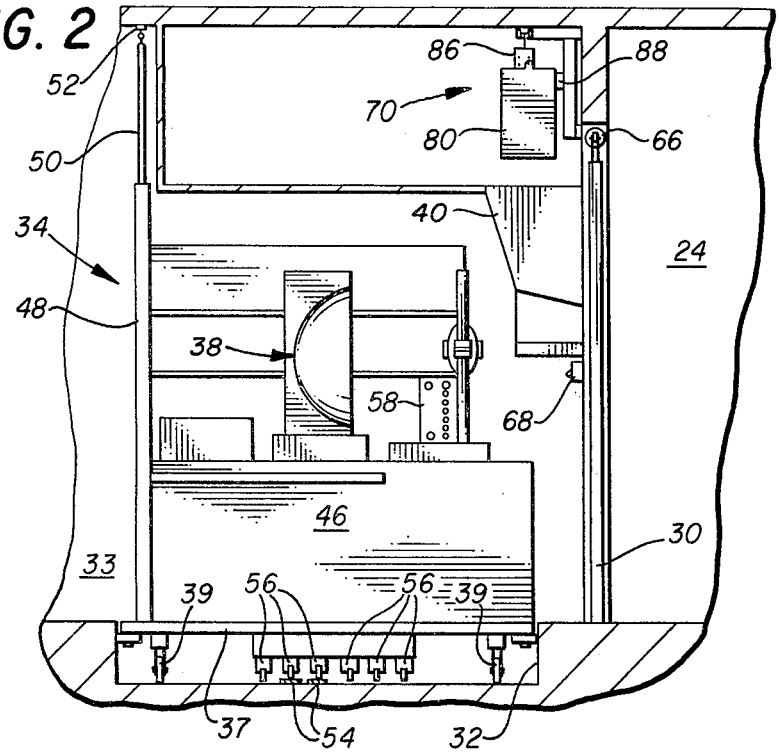
FIG. 2 is an elevational view taken along lines 2—2 of FIG. 1 in the direction of the arrows.
Figure 3:
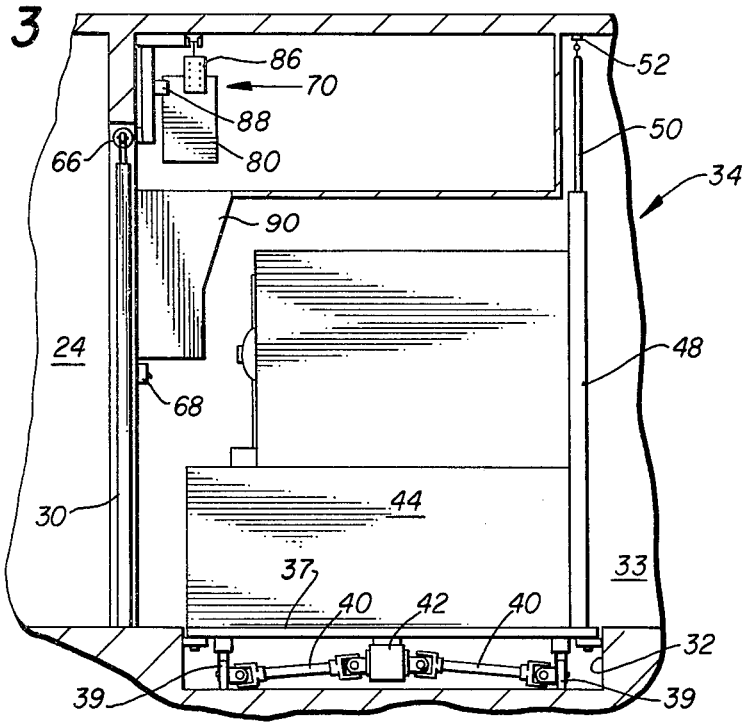
FIG. 3 is an elevational view taken along lines 3—3 of FIG. 1 in the direction of the arrows.
Figure 5:
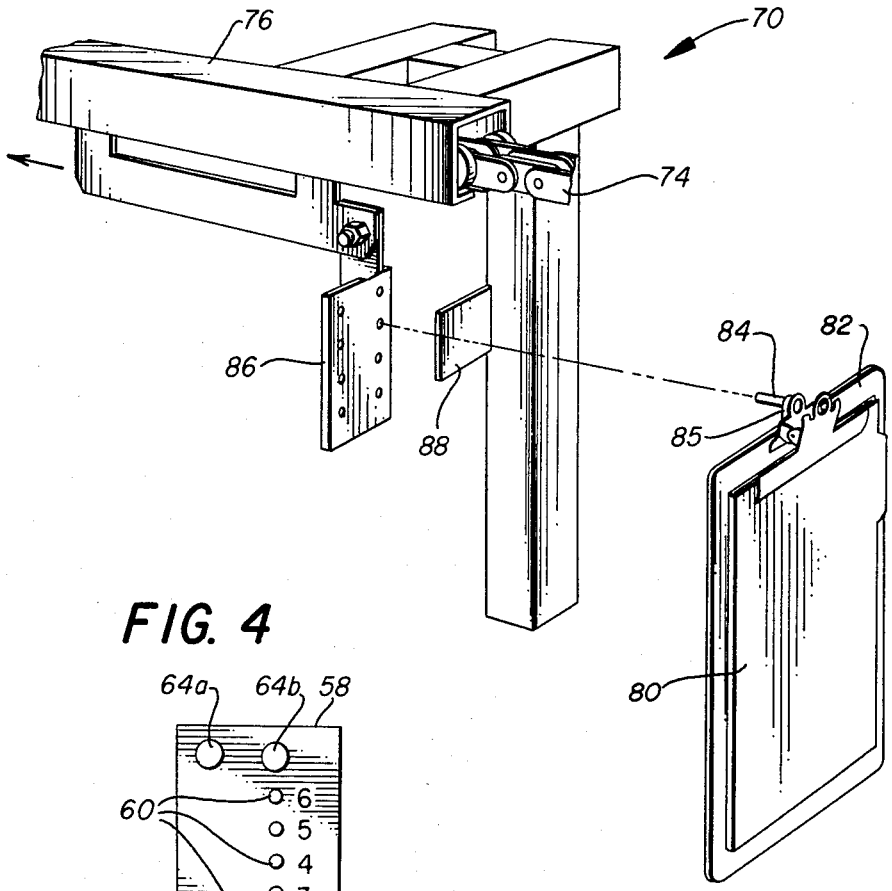
FIG. 5 is a perspective view of a portion of the chart conveyor system utilized with the invention.

Further details of transfer cart 34 are shown in FIGS. 2 and 3. Car 34 includes a base 37 which is supported for movement within pit 32 by wheels 39. The top surface of base 37 is substantially even with the floor of work area 33 so that auxiliary equipment can be wheeled onto cart 34 as necessary. One pair of wheels 39 is driven through half shafts 40 by a motor/brake unit 42 which is controlled by suitable controls provided for manipulation on cart 34. Upstanding walls 44 and 46 are mounted on opposite ends of base 37 and are interconnected by an open frame 48. The central area of cart 34 is thus substantially open except for rolling chair 36 so that a patient in an examining room 24 can look through the cart at a chart projected on the wall 33*a* of storage area 33 as shown in dashed lines in FIG. 1. An electrical cord 50 slidably supported at intervals within a track 52 is connected between frame 48 and a suitable source of power for operating motor/brake unit 42 and other components of equipment 38 on cart 34.

Referring particularly to FIG. 2, the preferred embodiment of the invention includes a plurality of strips 54 located inside pit 32 adjacent to each examining room 24. Strips 54 are positioned for cooperation with microswitches 56 to which the motor/brake unit 42 is responsive through control panel 58. The microswitches 56 are arranged in a transverse row on the underside of base 37. Each set of strips 54 is preferably arranged in pit 32 to trip microswitches 56 in a predetermined sequence so that transfer cart 34 is brought to a controlled stop in proper position adjacent to the desired examining room 24.

Figure 4:
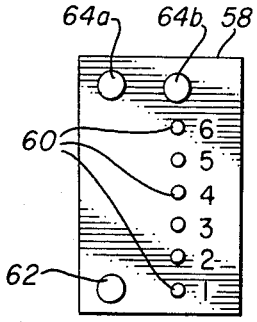
FIG. 4 is an illustration of the control panel on the movable cart.

FIG. 4 shows the control panel 58 by which transfer cart 34 is manipulated. Panel 58 includes a plurality of buttons 60 each of which corresponds to one of the examining rooms 24. The desired room 24 is selected by pressing one of the buttons 60, just as the desired floor is selected in an elevator, followed by depression of go button 62. Cart 34 then travels to the desired examining room 24. Final positioning of the cart 34 can be adjusted by means of left jog button 64*a* or right jog button 64*b*.

Referring again to FIGS. 2 and 3, the sliding doors 30 for each examining room 24 are driven by an actuator 66 through an outside switch 68 positioned for manipulation by the doctor on cart 34. Actuators 66 can comprise either hydraulic or electric units of conventional construction. When transfer cart 34 arrives at a particular examining room 24, the doctor can thus take a few moments to review the chart of the patient therein before actuating switch 68 to open doors 30.

Referring now to FIG. 4 in conjunction with FIG. 1, the medical office 10 of the invention preferably includes an overhead conveyor system 70 for transferring patient charts from the reception desk 18 to examining rooms 24. Conveyor system 70 includes an endless chain 74 mounted for movement around the path indicated with dashed lines in FIG. 1. Chain 74 can be supported by a track 76 as shown in FIG. 4 over the straight portions of the path. Motor 78 drives chain 74.

The chart 80 for a particular patient is first attached to a clipboard 82 by personnel at area 18*a* behind the reception desk 18. The clipboard 82 and chart 80 are then connected by means of a peg 84 and magnetic retainer 85 to one of the carriers 86 mounted at intervals on chain 74.

Each carrier 86 includes a plurality of apertures each adapted to receive the peg 84 extending from a clipboard 82. The apertures of carrier 86 are arranged in a predetermined pattern with each aperture corresponding to one of the examining rooms 24 or other locations along the conveyor path. The patient chart 80 is thus connected to carrier 86 in a predetermined position corresponding to the desired destination.

A stationary projection 88 is provided adjacent to the conveyor path at each examining room 24 to disengage clipboard 82 and chart 80 from carrier 86 so that they fall into an underlying chute or drop box 90 for that particular examining room or location. Each projection 88 is positioned to impinge only upon the clipboard 82 and chart 80 meant to be deposited in the drop box 90 for that particular location. The chart 80 for the particular patient will thus be waiting for the doctor when transfer cart 34 arrives at that examining room 24. If denied, another projection and drop box (not shown) can be provided at area 18*a* to receive clipboards 82 which may not have fallen into a drop box 76, or which may have been reattached to chain 74 for return.

From the foregoing, it will be apparent that the present invention comprises an improved medical office construction having several advantages over the prior art. Supporting specialized equipment on a cart mounted for linear movement between multiple examining rooms achieves more efficient equipment utilization and facilitates treatment of more patients. Other advantages will be evident to those skilled in the art.

Although particular embodiments of the invention have been illustrated in the accompanying Drawings and described in the foregoing Detailed Description, it will be understood that the invention is not intended to be limited only to the embodiments disclosed, but embraces any alternatives, equivalents, modifications and/or rearrangements of elements falling within the scope of the invention as defined by the following claims.

I claim:

1. A medical office construction, comprising:

a plurality of examining rooms arranged in side by side relationship;

platform means mounted for movement along a path extending along one side of all of said examining rooms for supporting and transporting at least one person together with medical equipment thereon;

a normally closed door mounted in said one side of each examining room;

means associated with said platform for selectively opening said normally closed door of each examining room when said platform means is positioned adjacent thereto to permit movement of persons between said room and said platform means and free access from said room to the medical equipment on said platform means; and a patient entry door mounted on another side of each examining room.

2. The medical office construction of claim 1, wherein said platform means comprises:

a base;

wheels rotatably mounted on said base to support said platform for movement;

drive means coupled to said wheels; and means associated with said platform for controlling said drive means.

3. The medical office construction of either of claims 1 or 2, further including:

a common hallway extending along the opposite side of said examining rooms providing patient access to said examining rooms through said patient entry doors;

a reception desk located along said hallway;

a plurality of drop boxes, one associated with each patient examining room;

said drop boxes being located along the path of said platform means; and means for conveying patient charts from said reception desk area and depositing the charts into said drop boxes.

4. The medical facility construction of claim 3, wherein said normally closed door comprises:

at least one sliding door;

actuator means for moving said sliding door between open and closed positions; and switch means for controlling said door actuator means.

5. A medical facility construction, comprising:

a plurality of examining rooms arranged side by side in a row;

platform means mounted for movement along a path extending along one side of all of said examining rooms for supporting and transporting one or more persons together with medical equipment mounted on said platform means;

a normally closed sliding door facing the path mounted in one side of each patient examining room;

means for selectively opening said normally closed sliding door of each examining room when said platform means is positioned adjacent thereto to permit movement of persons and communication between said examining room and the medical equipment on said platform means;

a plurality of drop boxes located along the platform path each corresponding to one of said patent examining rooms;

means for conveying patient charts from a remote area and selectively depositing the charts into said drop boxes;

a patient entry door mounted in another side of each examining room;

a common hallway extended along said other side of said examining rooms providing patient access to said examining rooms through said patient entry doors; and additional space along the length of said path on the opposite side of said path from said examining rooms accessible from said platform and adapted to house medical equipment requiring more space than available solely on said platform.

6. The medical facility construction of claim 5, wherein said medical equipment comprises ophthalmic examination equipment mounted at least in part on said platform means for movement therewith.

7. The medical facility construction of claim 5, wherein said platform means comprises:

a base;

wheels rotatably mounted on said base to support said platform for movement;

drive means coupled to said wheels; and means associated with said platform for controlling said drive means;

the top surface of said base being substantially even with the floor of said additional space and with the floor of said examining rooms.

* * * * *